US007322263B2

(12) United States Patent
Wu

(10) Patent No.: US 7,322,263 B2
(45) Date of Patent: Jan. 29, 2008

(54) WRENCH CAPABLE OF SWITCHING SENSE OF ROTATION

(75) Inventor: Arthur Wu, Taipei (TW)

(73) Assignee: Proxene Tools Co., Ltd., Shen Kang Hsiang, Taichung (TW)

( * ) Notice: Subject to any disclaimer, the term of this patent is extended or adjusted under 35 U.S.C. 154(b) by 0 days.

(21) Appl. No.: 11/507,275

(22) Filed: Aug. 22, 2006

(65) Prior Publication Data

US 2007/0039421 A1 Feb. 22, 2007

(30) Foreign Application Priority Data

Aug. 22, 2005 (TW) ..... 94128631 A

(51) Int. Cl.
*B25B 13/46* (2006.01)

(52) U.S. Cl. ..... 81/63.2; 81/63

(58) Field of Classification Search ..... 81/60, 81/63, 63.2

See application file for complete search history.

(56) References Cited

U.S. PATENT DOCUMENTS

| | | | | |
|---|---|---|---|---|
| 3,970,155 | A * | 7/1976 | Otto | 73/862.26 |
| 4,125,016 | A * | 11/1978 | Lehoczky et al. | 73/862.23 |
| 4,280,379 | A * | 7/1981 | Chow | 81/62 |
| 4,336,728 | A * | 6/1982 | Deibert | 81/62 |
| 4,762,032 | A * | 8/1988 | Chow | 81/63 |
| 6,167,788 | B1 * | 1/2001 | Schonberger et al. | 81/467 |
| 6,886,428 | B1 * | 5/2005 | Hsien | 81/63.2 |
| 2005/0257651 | A1 * | 11/2005 | Chen | 81/63.2 |

* cited by examiner

*Primary Examiner*—David B Thomas

(57) ABSTRACT

A wrench capable of switching sense of rotation comprises a handle, a head portion formed on one end of the handle and a switch mounted on the head portion of the handle. The head portion further comprises a ratchet wheel, a claw piece and an inverting piece. The switch further comprises two driving pieces downwardly extended from two lateral sides thereof. As either side of the switch is pressed down, the associated driving piece will be pushed against the inverting piece with a sloppy wall thereof, so as to restrict the rotation of the ratchet in one angular direction.

12 Claims, 9 Drawing Sheets

WRENCH CAPABLE OF SWITCHING SENSE OF ROTATION

FIELD OF THE INVENTION

The present invention relates to manual tools, more particularly to a wrench capable of switching sense of rotation.

BACKGROUND OF THE INVENTION

Referring to FIG. 9, a ratchet wrench 102 of the prior art comprises a handle 104 and a head section 106 further including a ratchet wheel 108, a claw piece 110, an inverting piece 112 and a rotational switch 114. Thereby, a user can twist the rotational switch 114 so as to switch the claw piece 110 to either the left side or the left side of the ratchet wheel 108. Therefore, the wrench can either fasten or loosen a screw bolt or nut (not shown in the figure).

Referring to FIG. 10, another ratchet wrench 116 of the prior art comprises a handle 118 and a heat section 120 further including a ratchet wheel 122 and an inverting piece 124. The inverting piece 124 being an elongated bar has a central notch with a right teeth section and a left teeth section (126), whereby the inverting piece 124 can be shifted transversely to have either one of the teeth sections to engage with the ratchet wheel 122. Therefore, the wrench can either fasten or loosen a screw bolt or nut (not shown in the figure).

Referring to FIG. 11, a third ratchet wrench 128 of the prior art comprises a head section 132 and a handle 130; there is a ratchet wheel in the head section 132, which is not shown in the figure. The head section 130 further includes a claw piece 136, an inverting piece 138 and a switch 140 having a central portion pivotally connected to the head section 132, whereby either of two ends of the switch 140 can be pressed so that the inverting piece 138 housed within a front hole 142 of the switch 140 can drive the claw piece 136 to engage with the ratchet wheel to restrict its rotation in one direction. Therefore, the wrench can either fasten or loosen a screw bolt or nut (not shown in the figure).

SUMMARY OF THE INVENTION

Accordingly, the primary objective of the present invention is to provide a wrench capable of switching sense of rotation. When either side of a switch is pressed down, an associated driving piece underneath the switch will be pressed against the inverting piece with a sloppy wall of the driving piece, so as to restrict the rotation of the ratchet in one angular direction. When the other side of the switch is pushed, the other driving piece will drive the inverting piece to switch the allowed rotational direction.

DETAILED DESCRIPTION OF THE PREFERRED EMBODIMENTS

The various objects and advantages of the present invention will be more readily understood from the following detailed description when read in conjunction with the appended drawings.

Figure 1:
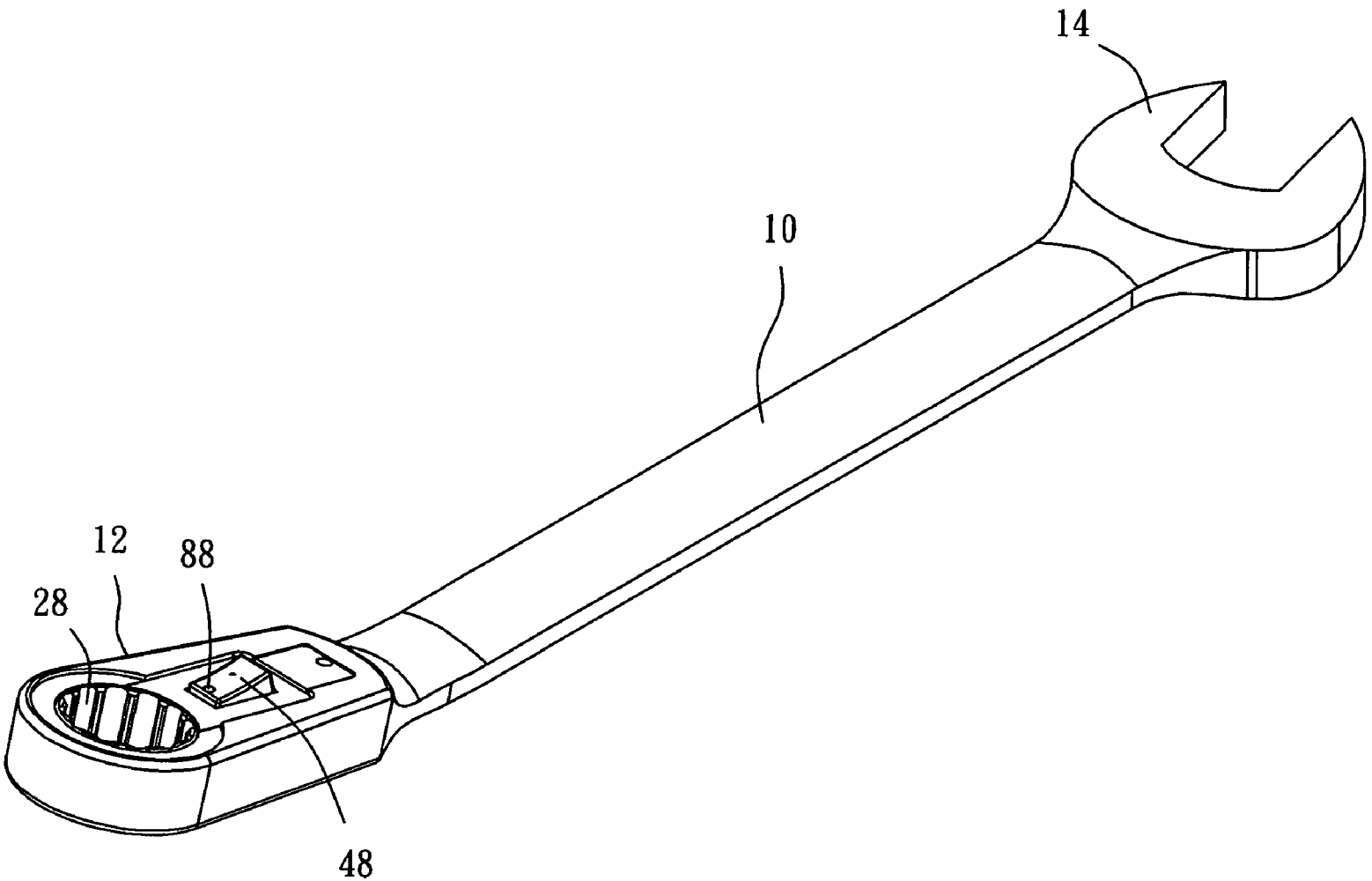
FIG. 1 is a perspective view of the first preferred embodiment of the present invention as a wrench capable of switching sense of rotation.
Figure 2:
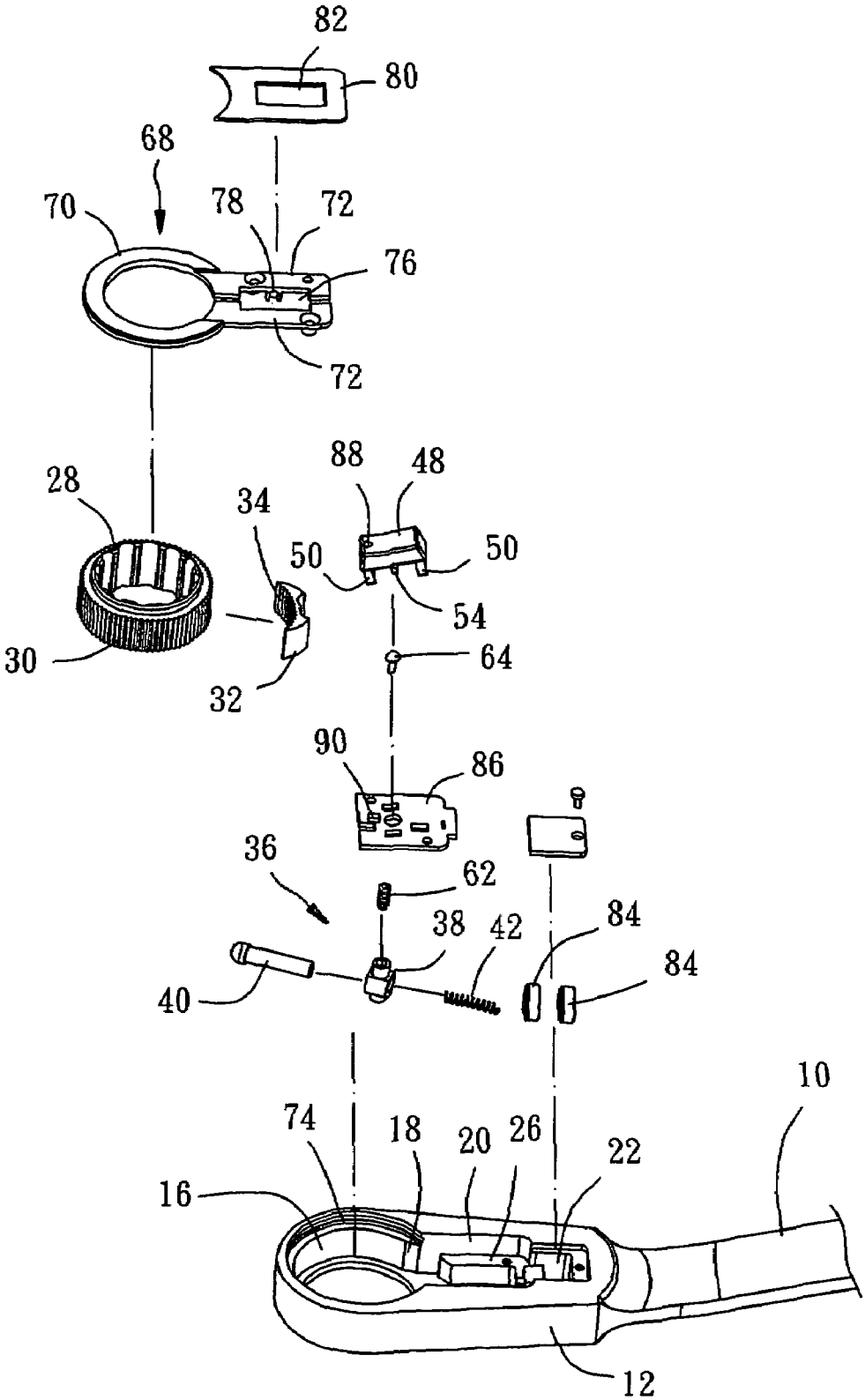
FIG. 2 is an exploded perspective view of the wrench capable of switching sense of rotation in FIG. 1.

Referring to FIGS. 1 and 2, an preferred embodiment of the present invention as a wrench capable of switching sense of rotation comprises a handle 10, a ratchet wheel 28, a claw piece 32, an inverting piece 36 and a switch 48. The handle 10 has a head portion 12 at one end and a web portion 14 at the other end. The head portion 12 is provided with a first receptacle 16, a second receptacle 18, a third receptacle 20 and a battery room 22. The second receptacle 18 is located between the first receptacle 16 and the third receptacle 20; the three receptacles are interconnected. Each of the first receptacle 16 and the third receptacle 20 has an open first end and a closed second end. The third receptacle 20 further includes a central groove 24 surrounded by a U-shaped wall section 26.

The ratchet wheel 28 has an encircled teethed circumference 30. The ratchet wheel 28 is housed in the first receptacle 16 and capable of being rotated freely therein.

The claw piece 32 is housed in the second receptacle 18, having a teeth part 34 at one end thereof. The claw piece 32 is capable of engaging and leaving the teethed circumference 30. Further, the claw piece 32 is capable of being shifted around to attach to either of two lateral sides of the second receptacle 18.

Figure 4:
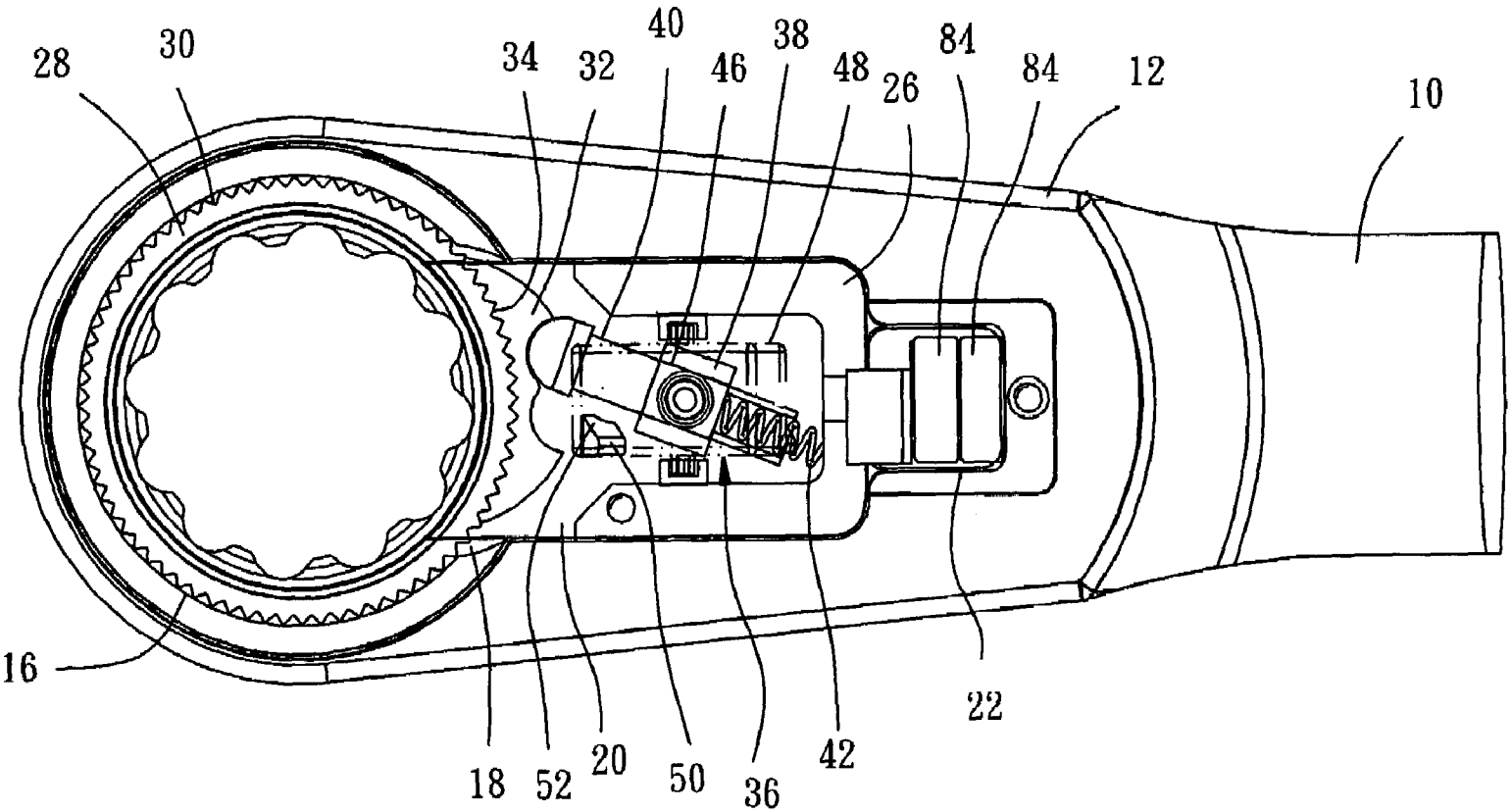
FIGS. 4 and 5 are respectively a top and lateral cross-sectional views of the switch of the wrench capable of switching sense of rotation in FIG. 1, wherein the front of the switch is pressed to drive the inverting piece to the first position.
Figure 6:
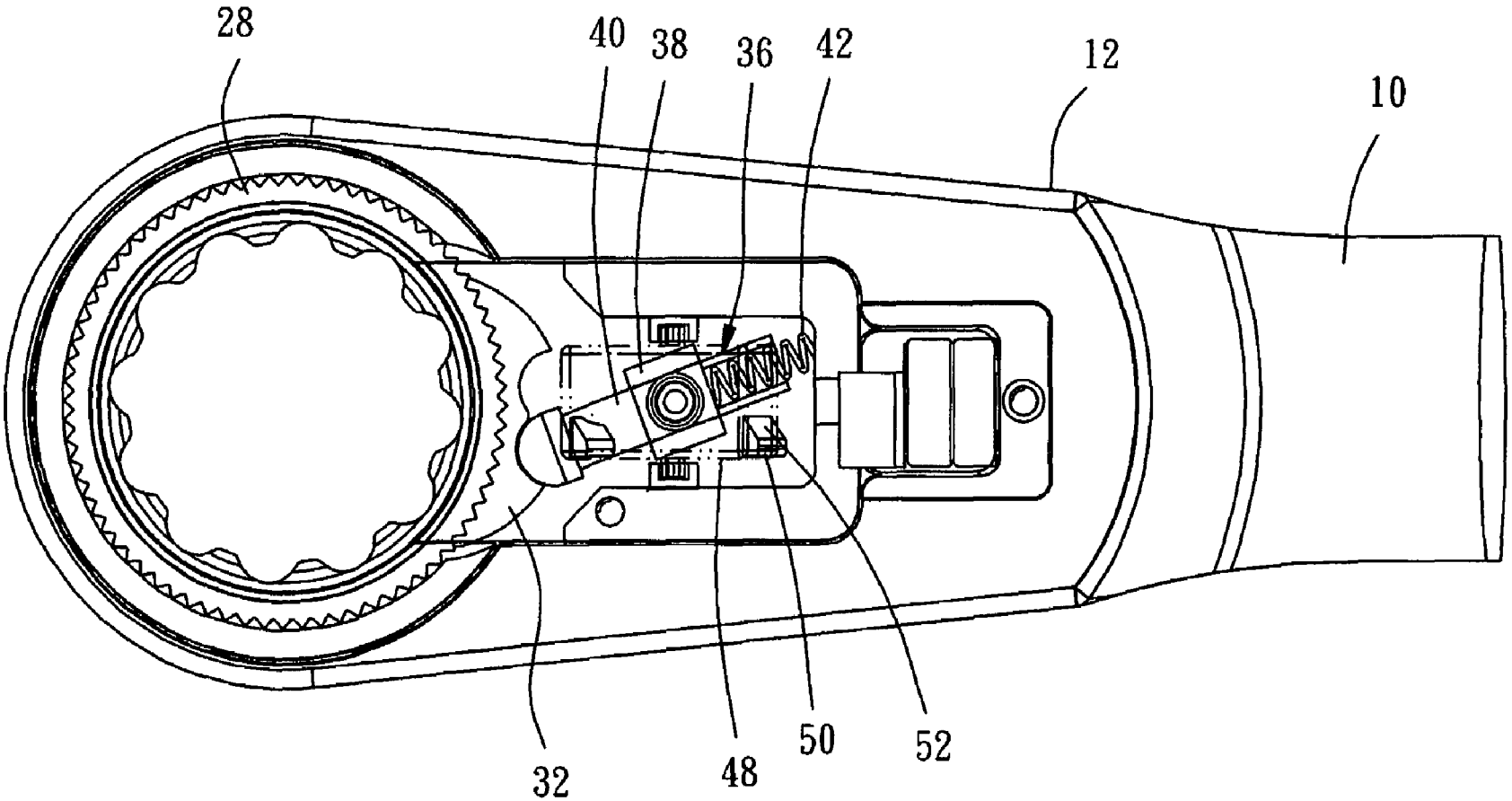
FIGS. 6 and 7 are respectively a top and lateral cross-sectional views of the switch of the wrench capable of switching sense of rotation in FIG. 1, wherein the rear of the switch is pressed to drive the inverting piece to the second position.
Figure 7:
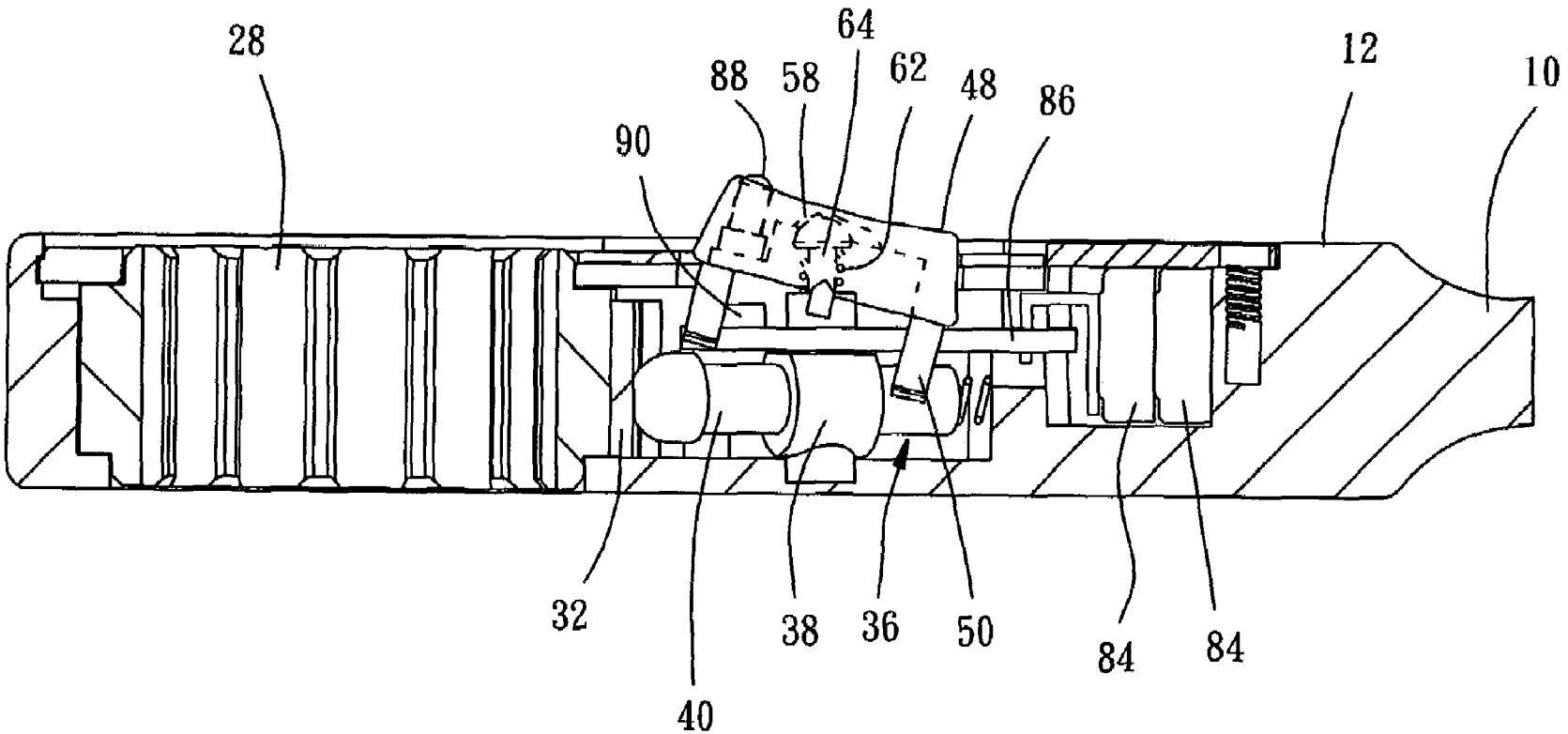
Figure 10:
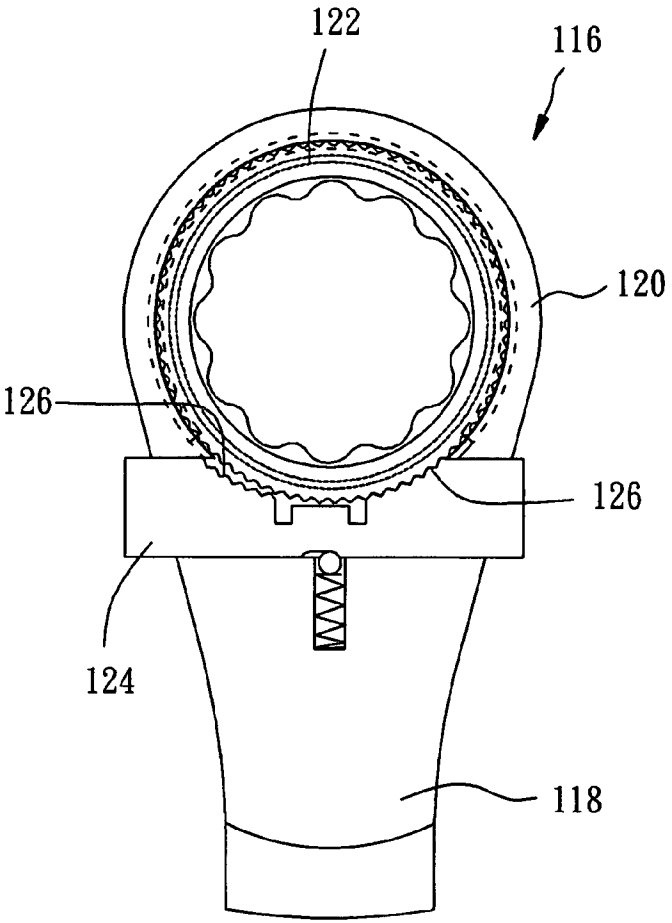
FIG. 10 illustrates the second wrench capable of switching sense of rotation of the prior art.
Figure 9:
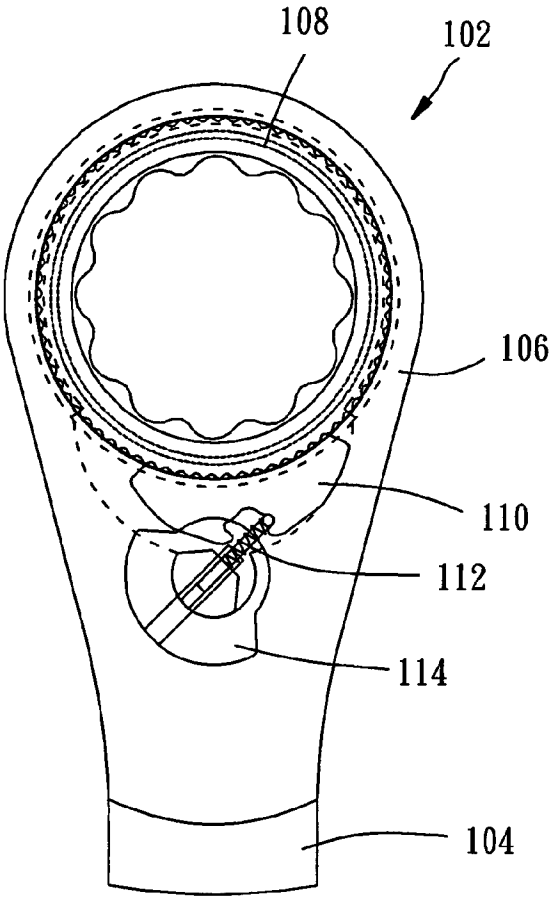
FIG. 9 illustrates the first wrench capable of switching sense of rotation of the prior art.
Figure 11:
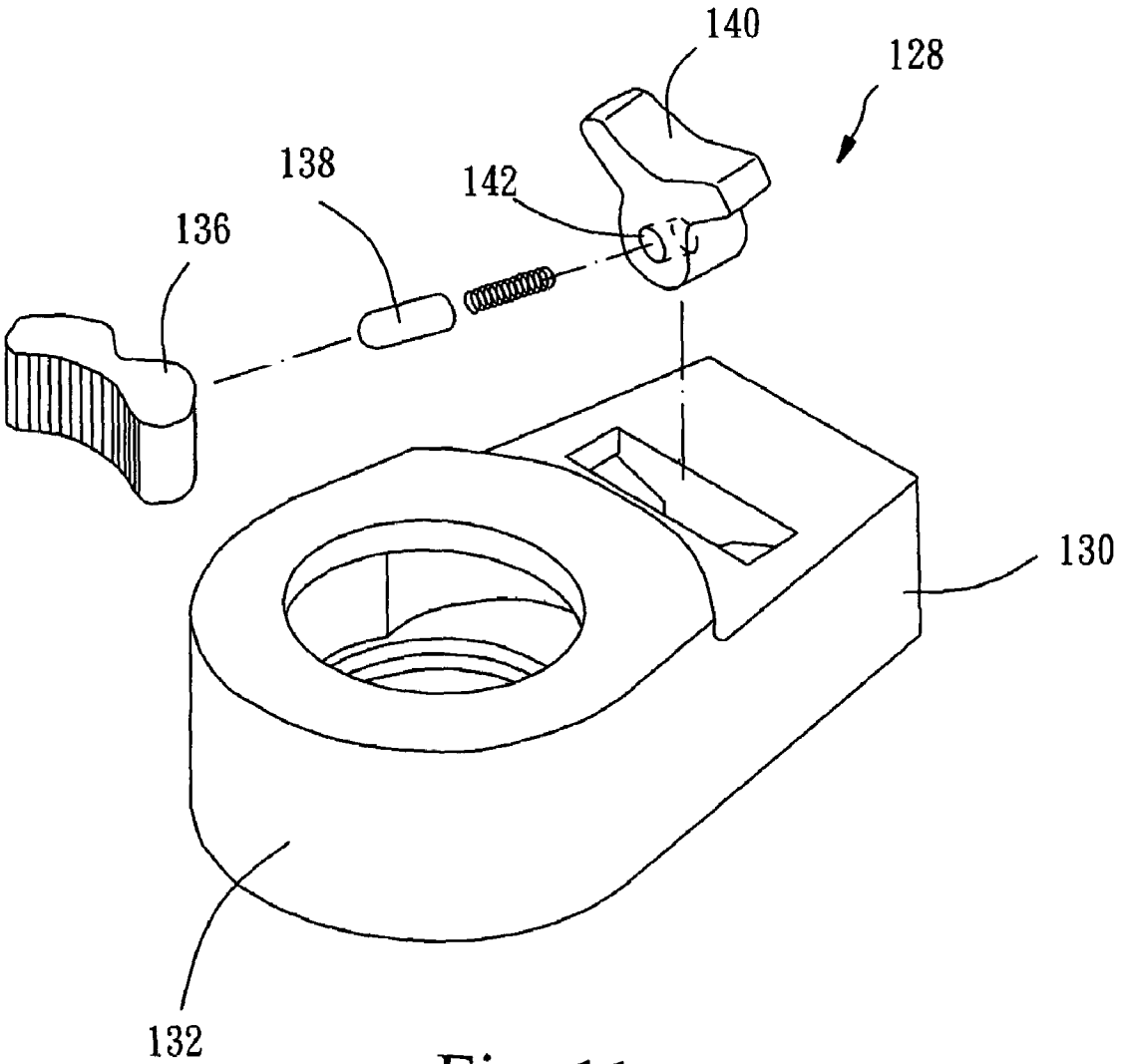
FIG. 11 illustrates the third wrench capable of switching sense of rotation of the prior art.

The inverting piece 38 comprises a rotational base 38, a push piece 40 and a spring 42. The rotational base 38 has a pivot pin 44 embedded in the groove 24 on the bottom of the third receptacle 20 and a transverse passage 46 for holding the middle section of the push piece 40. One end of the spring 42 is held within a hole at the rear end of push piece 40, and the other end of the spring 42 is supported against a wail of the second receptacle 18. Thereby, the push piece 40 can rotate about the pivot pin 44, switching back and forth between a first angular position and a second angular position. As shown in FIG. 4, as the push piece 40 moves in the first angular position, the claw piece 32 is on the right side of the second receptacle 18. As shown in FIG. 6, as the push piece 40 moves in the second angular position, the claw piece 32 is on the left side of the second receptacle 18.

Figure 3:
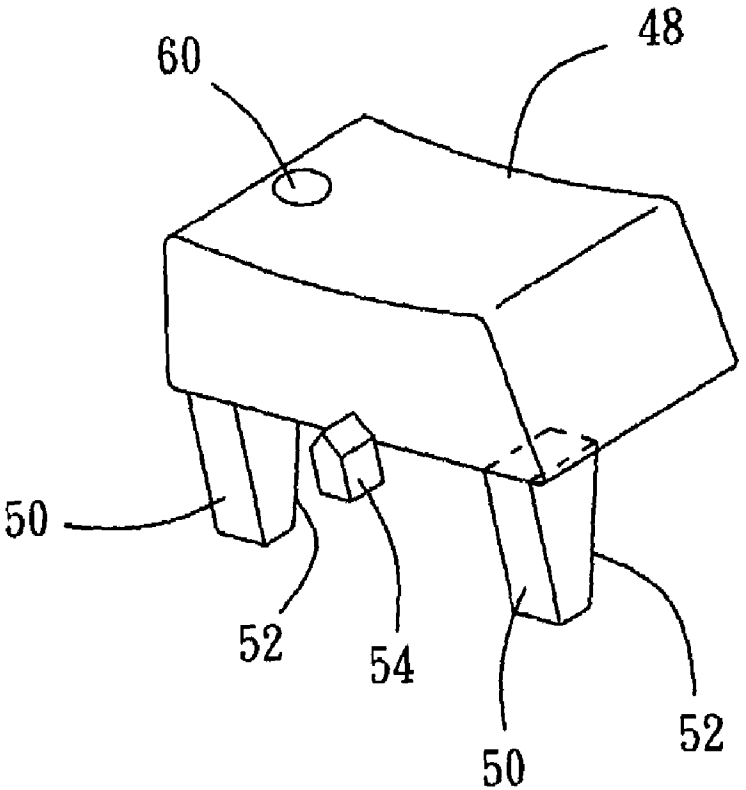
FIG. 3 is a perspective view of the switch of the wrench capable of switching sense of rotation in FIG. 1.

As shown in FIG. 3, the switch 48, installed in the head portion 14 of the handle 10, has two ends that can be pressed down and a pair of bottom driving pieces 50. Each of the driving pieces 50 has an inwardly tilted wall 52. The two sides of the space between the driving pieces 50 are respectively provided with projections 54. As shown in FIGS. 4 and 6, the bottom side of the switch 48 is provided with a groove 56 with a pair of partially overlapping circular recesses 58. The switch 48 further includes a through hole 60 aside the groove 56, a spring 62 and a support pin 64, consequently installed within a top hole of the pivot pin 44 of the inverting piece 36. The support pin 64 is further provided with a semi-spherical head 66 that is retained in one of the recesses 58 of the switch 48. There is further a retaining plate 68 having a C-shaped ring 70 and a pair of tail pieces 72. The tail pieces 72 is a distance apart, which can be squeezed to shrink the distance so that the C-shaped ring 70 can be retained within a groove 74 on the inner annual wall of the first receptacle 16. The tail pieces 72 are extended to cover the second and the third receptacles (18, 20), with their free ends be supported by the wall section 26 and fastened by a screw. The tail pieces 72 have an opening 76 extended out of the switch 48, which opening 76 in turn has two retaining depressions 78 for retaining the two projections 54 of the switch 48. The switch 48 further includes a cover plate 80 covering the tail pieces 72 of the retaining plate 68. The cover plate 80 has a central hole for exposing the switch 48.

The battery room 22 contains two batteries 84, and there is a circuit board 86 in the third receptacle 20. There is further a light emitting cylinder 88 inserted in the through hole 60 of the switch 48. The light emitting cylinder 88 can be a light emitting diode (LED). A conductive plate connects the batteries 84 and the circuit board 86. The circuit board 86 further has an electrode 90 that will be activated to light up the light emitting cylinder 88 when either the front end or the rear end of the switch 48 is pressed down.

Figure 5:
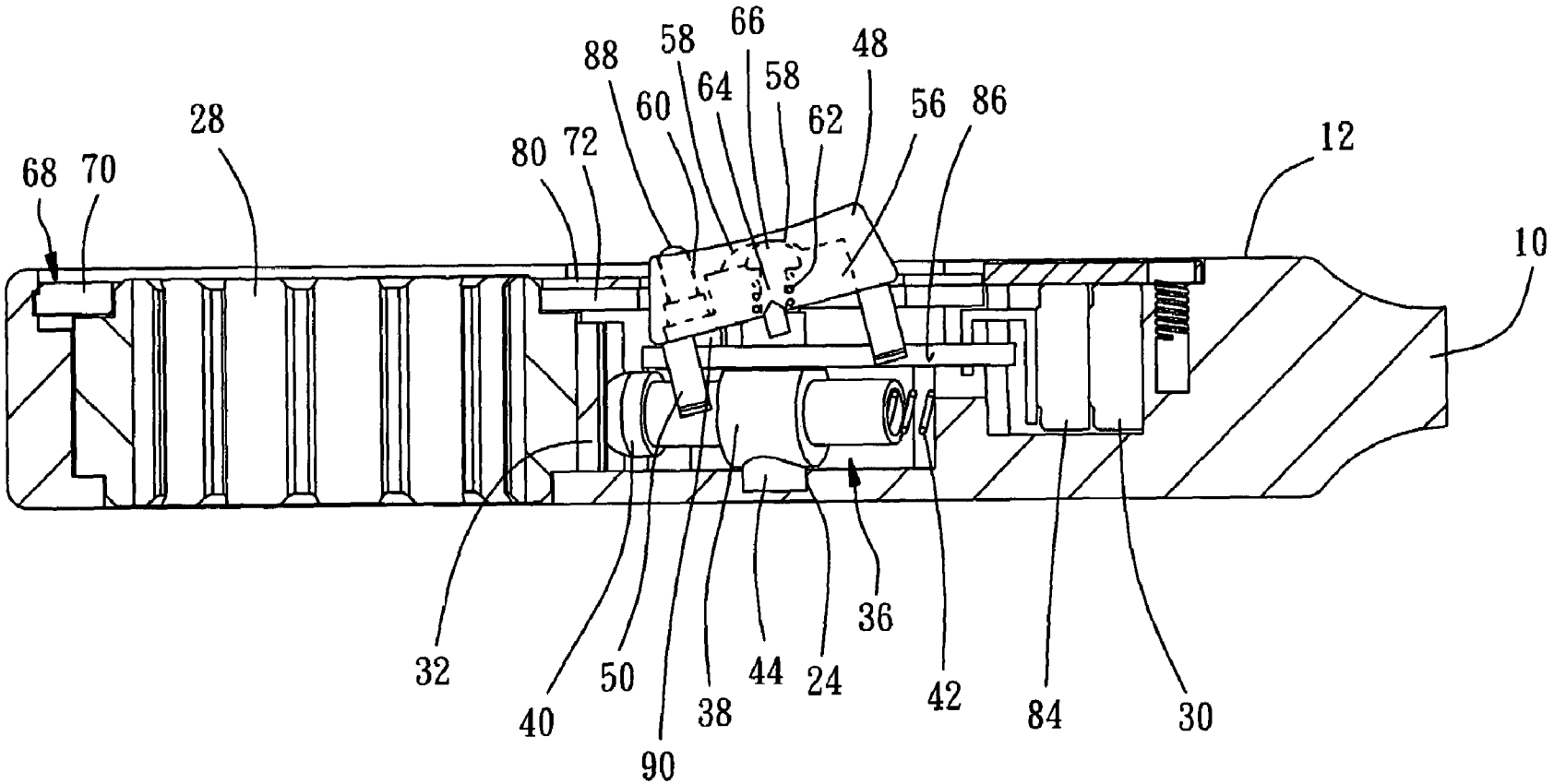

Referring to FIGS. 4 and 5, when the front end of the switch 48 is pressed down, the spring 62 will be bent and then drive the semi-spherical head 66 on the support pin 64 to the rear one of the recesses 58, simultaneously lighting up the light emitting cylinder 88. Thereby, the rear one of the driving pieces 50 will move up, whereas the front one will move down, whereby an inner tilted wall 52 will push the front end of the push piece 40 to drive the push piece 40 to the first angular position. On the other hand, when the rear one of the driving pieces 50 moves down and the front one will move up, an inner tilted wall 52 will drive the push piece 40 to the second angular position, simultaneously turning off the light emitting cylinder 88.

Thereby, a user can switch the rotational direction of the wrench of the present invention easily, just like operating a common appliance. Since the inverting piece 36 is parallel to the push piece 40, there will be no dislocation during an operation. Further, the lighting status of the light emitting cylinder 88 can be used to indicate the rotational direction of the wrench and therefore the status of loosening or fastening of a bolt.

Figure 8:
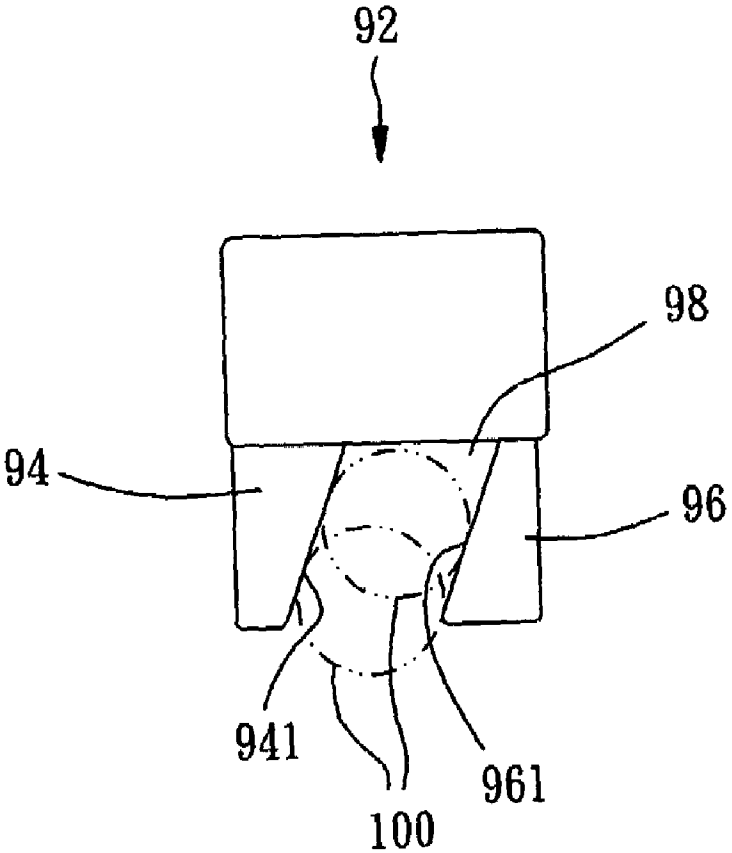
FIG. 8 is a perspective view of the second preferred embodiment of the present invention as a wrench capable of switching sense of rotation.

Referring to FIG. 8, the second preferred embodiment of the present invention has two driving pieces 94, 96 having two opposite tilted walls 941, 961. A track 98 is formed between the tilted walls 941, 961 for the passage of the inverting piece 100. By the same token, the push piece 40 can rotate about the pivot pin 44, switching back and forth between a first angular position and a second angular position. As the push piece 40 moves in the first angular position, the claw piece 32 is on the right side of the second receptacle 18. As the push piece 40 moves in the second angular position, the claw piece 32 is on the left side of the second receptacle 18.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A wrench capable of switching sense of rotation, comprising:

a handle having a head portion with a first, a second and a third receptacles, said second receptacle being located between said first and said third receptacles, said three receptacles are interconnected;

a ratchet wheel having an encircled teethed circumference, said ratchet wheel being housed in said first receptacle and capable of being rotated freely;

a claw piece housed in said second receptacle, said claw piece having a teeth part at one end thereof capable of engaging and leaving said teethed circumference, said claw piece being capable of being shifted around to attach to either of two lateral sides of said second receptacle;

an inverting piece housed in said third receptacle and tilted a against said claw piece, whereby by said inverting piece can be rotated between a first and a second angular positions, said claw piece will shift to a right lateral side in the second receptacle as said inverting piece in said first angular position, said claw piece will shift to a left lateral side in the second receptacle as said inverting piece in said second angular position; and a switch installed said the head portion of said handle having two ends that can be pressed down and a pair of bottom driving pieces, each of said driving pieces having a tilted wall for pushing against one side of said inverting piece when one of said two ends of said switch is pressed, whereby said inverting piece can be driven by said driving pieces to attain either of said first and said second angular positions; and wherein said inverting piece has a pivotal column, a support piece and a spring; said pivotal column having a slot for retaining said support piece; one end of said spring supporting against a lateral wall of said third receptacle; another end of said spring supporting against said support piece, whereby an outer end of said support piece pushing against said claw piece.

2. The wrench capable of switching sense of rotation of claim 1 wherein one end of said pivotal column is housed in a groove at a bottom end of said third receptacle.

3. The wrench capable of switching sense of rotation of claim 1 wherein said switch further comprises a rod body and a spring; said spring recoiling to push said rod body against one of said partially overlapping circular recesses, whereby said rod body will be retained when either said front end or said rear end of said switch is pressed down.

4. The wrench capable of switching sense of rotation of claim 1 wherein further comprising a retaining plate with a C-shaped ring plate and a pair of tail pieces a distance apart; said tail pieces capable of being squeezed so that said ring plate can be inserted into a groove on a ring wall of said first receptacle, leaving said tail pieces covering said second and said third receptacles.

5. The wrench capable of switching sense of rotation of claim 4 wherein said third receptacle is provided with a wall section for supporting said tail pieces extended from said retaining plate.

6. The wrench capable of switching sense of rotation of claim 4 further comprising a cover plate attached onto said tail pieces extended from said retaining plate.

7. The wrench capable of switching sense of rotation of claim 1 wherein two said driving pieces of said switch have two tilted walls with the same slope, respectively corresponding to two sides of a pivotal center of said inverting piece.

8. The wrench capable of switching sense of rotation of claim 1 wherein two said driving pieces of said switch have two opposite tilted walls; a track being formed between said tilted walls for the passage of said inverting piece.

9. The wrench capable of switching sense of rotation of claim 1 wherein further comprising a light emitting cylinder and a battery set including at least a battery, whereby, as either said front end or said rear end of said switch is pressed down, said battery set will be connected to said light emitting cylinder for indicating the rotational direction of said ratchet wheel.

10. The wrench capable of switching sense of rotation of claim 9 wherein head portion further comprises a battery room for housing said battery set.

11. The wrench capable of switching sense of rotation of claim 9 further comprising a circuit board located below said switch and connected to said battery set; said circuit board having an electrode that will be activated to light up said light emitting cylinder when either said front end or said rear end of said switch is pressed down.

12. The wrench capable of switching sense of rotation of claim 9 wherein said light emitting cylinder is located above said switch.

* * * * *